US006525124B1

(12) United States Patent
Hiraoka et al.

(10) Patent No.: US 6,525,124 B1
(45) Date of Patent: Feb. 25, 2003

(54) GOLF BALL

(76) Inventors: Hidenori Hiraoka, 2208-42, Nishioka, Uozumi-cho, Akashi-shi, Hyogo-ken (JP); Kazushige Sugimoto, 102, Tohokudenryoku Kitamabune Daiichishataku, 151, Aza Kitamabune, Shirakawa-shi, Fukushima-ken (JP); Tsutomu Hirau, 306, Vega Nakagami, 11, Aza Shibayama, Shimotanigami, Yamada-cho, Kita-ku, Kobe-shi, Hyogo-ken (JP); Yoshimasa Koizumi, 2-1-1008, Aza Mabune, Shirakawa-shi, Fukushima-ken (JP)

( * ) Notice: Subject to any disclaimer, the term of this patent is extended or adjusted under 35 U.S.C. 154(b) by 0 days.

(21) Appl. No.: 08/685,680

(22) Filed: Jul. 24, 1996

(30) Foreign Application Priority Data

Jul. 25, 1995 (JP) ..... 7-209970
Jun. 5, 1996 (JP) ..... 8-166748

(51) Int. Cl.[7] ..... A63B 37/06; A63B 37/12
(52) U.S. Cl. ..... 524/426; 473/372; 473/377; 473/383
(58) Field of Search ..... 473/372, 377, 473/383; 524/426

(56) References Cited

U.S. PATENT DOCUMENTS 4,169,599 A * 10/1979 Fujio
4,611,810 A * 9/1986 Kamata
4,679,795 A * 7/1987 Melvin ..... 524/100
4,726,590 A * 2/1988 Molitor ..... 525/123
4,968,038 A * 11/1990 Yamada
5,116,060 A * 5/1992 Sullivan ..... 525/265
5,127,655 A * 7/1992 Yamada
5,387,637 A * 2/1995 Sullivan ..... 524/493

OTHER PUBLICATIONS

Suryln Product Guide p. 4,5 Oct. 1993.*

* cited by examiner

*Primary Examiner*—David J. Buttner
(74) *Attorney, Agent, or Firm*—Birch, Stewart, Kolasch & Birch, LLP

(57) ABSTRACT

The present invention provides a golf ball having excellent durability, sufficient for use in driving ranges while maintaining sufficient flight distance and shot feel for use in playing a round of golf. The golf ball comprises a core and a cover covering the core, wherein the core is composed of a vulcanized molded article of a rubber composition comprising 100 parts by weight of a base rubber containing not less than 80% by weight of a butadiene rubber having not less than 80 molar % of cis-1,4 bond, 10 to 30 parts by weight of calcium carbonate, 18 to 35 parts by weight of zinc acrylate or methacrylate and 0.5 to 2.5 parts by weight of a peroxide, and the cover is made from a resin composition having a flexural modulus of 1,400 to 3,800 kgf/cm$^2$, wherein the total volume of dimples of the cover is from 250 to 400 mm$^3$.

10 Claims, 1 Drawing Sheet

GOLF BALL

FIELD OF THE INVENTION

The present invention relates to a golf ball comprising a core and a cover covering the core. More particularly, the present invention relates to a golf ball having excellent durability for enduring driving range use while maintaining sufficient flight distance and shot feel.

BACKGROUND OF THE INVENTION

A solid golf ball is classified roughly into an integrally molded one-piece golf ball; a two-piece golf ball composed of a solid core and a cover containing a resin such as ionomer as a main component, which covers the solid core; and a multi-piece golf ball (three or more piece golf ball) composed of a core and a cover covering the core wherein one or more intermediate layers are provided between the core and the cover, or the core or cover is made of two or more layers.

The one-piece golf ball is generally used as a golf ball for driving ranges and is inferior in flight distance and shot feel in comparison to a golf ball which is used by a golfer on a golf course. The one-piece golf ball does not give the same shot feel as a normal golf ball utilized when playing on a golf course, but does exhibit excellent durability, sufficient to endure repeated hitting, which is a strong requirement for golf balls used on driving ranges.

To the contrary, the two-piece golf ball is exclusively used when playing a round of golf and is designed with the view in mind of enhancing both flight distance and shot feel. The two-piece golf ball, however, may be easily cut when used as a driving range ball because of its extensive use.

It has been proposed to develop a golf ball which can be used for a normal round of golf ball and also has enough durability to endure driving range usage. Such a golf ball would also be advantageous for golfers having little experience in view of its excellent durability. This type of golf ball would also be advantageous from a practical point of view.

OBJECTS OF THE INVENTION

As a result of intensive investigations, it has been found that a golf ball having excellent durability, sufficient to ensure use on a driving range while maintaining sufficient flight distance and shot feel can be obtained by composing the core of a vulcanized molded material of a specific rubber composition containing calcium carbonate, forming the cover with a resin composition having a specific flexural modulus and defining the total volume of dimples on the cover within a specific range.

A main object of the present invention is to provide a golf ball having excellent durability sufficient to endure extensive use on a driving range while maintaining the flight distance and shot feel utilized in playing a round of golf.

This object as well as other objects and advantages of the present invention will become apparent to those skilled in the art from the following description with reference to the accompanying drawings.

BRIEF EXPLANATION OF THE DRAWINGS

The present invention will become more fully understood from the detailed description given hereinbelow and the accompanying drawings which are given by way of illustration only, and thus, are not limitative of the present invention, and wherein.

SUMMARY OF THE INVENTION

Figure 1:
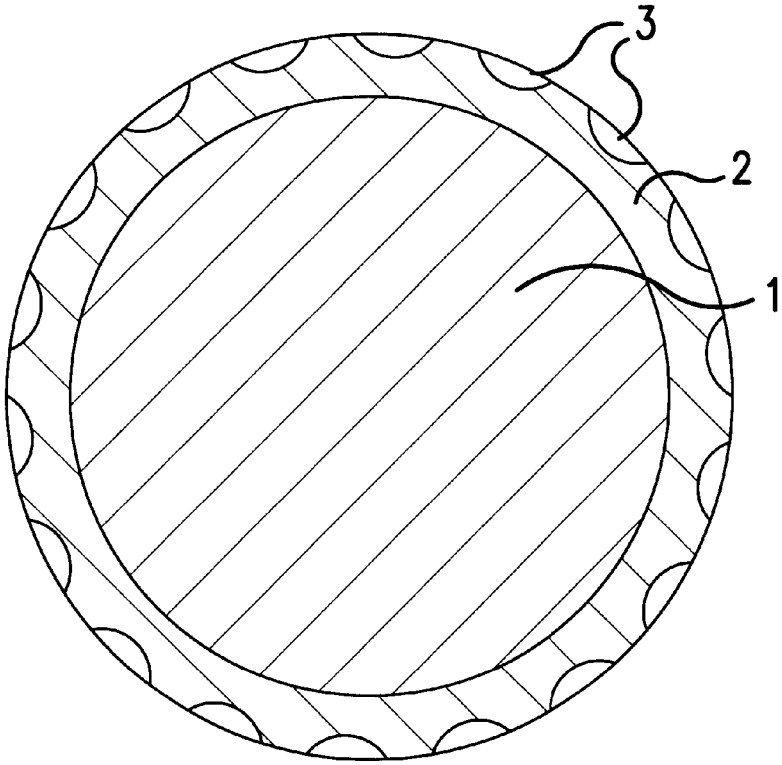
FIG. 1 is a schematic cross section illustrating one embodiment of the golf ball of the present invention.

Thus, is the present invention provides a golf ball comprising a core and a cover covering the core, wherein the core is composed of a vulcanized molded article of a rubber composition comprising 100 parts by weight of a base rubber containing not less than 80% by weight of a butadiene rubber having not less than 80 molar % of cis-1,4 bond, 10 to 30 parts by weight of calcium carbonate, 18 to 35 parts by weight of zinc acrylate or methacrylate and 0.5 to 2.5 parts by weight of a peroxide, and the cover is made of a resin composition having a stiffness of 1,400 to 3,800 kgf/cm$^2$, and the total volume of the dimples on the cover is from 250 to 400 mm$^3$.

DETAILED DESCRIPTION OF THE INVENTION

In the present invention, it is necessary that the base rubber of the rubber composition of the core (rubber composition for producing the core) contains not less than 80% by weight of a butadiene rubber containing not less than 80 molar % of a cis-1,4 bond. That is, the base rubber is composed only of a butadiene rubber containing not less than 80 molar % of a cis-1,4 bond, or composed of a mixture of not less than 80% by weight of the butadiene rubber containing not less than 80 molar % of a cis-1,4 bond and not more than 20% by weight of another rubber. Examples of the other rubbers are styrene-butadiene rubber, isoprene rubber, chloroprene rubber, butyl rubber, acrylic rubber, natural rubber, and the like, and a mixture thereof.

In the present invention, the reason why the base rubber of the rubber composition for the core (rubber composition for producing the core) containing not less than 80% by weight of a butadiene rubber containing not less than 80 molar % of a cis-1,4 bond is as follows. The butadiene rubber containing not less than 80 molar % of a cis-1,4 bond is superior in impact resilience, which leads to excellent flight distance and shot feel. When the amount of the other rubber is more than 20% by weight, the flight distance and shot feel are lowered.

In the present invention, calcium carbonate is used as one of fillers in an amount of 10 to 30 parts by weight based on 100 parts by weight of the base rubber. The reason why calcium carbonate is used in the amount of 10 to 30 parts by weight based on 100 parts by weight of the base rubber is as follows. Calcium carbonate contributes to an improvement in durability, flight distance, shot feel, etc. When the amount of calcium carbonate is less than 10 parts by weight based on 100 parts by weight of the base rubber, shot feel and durability are poor. On the other hand, when the amount of calcium carbonate is more than 30 parts by weight based on 100 parts by weight of the base rubber, durability is reduced and workability using a kneader, roller, etc. is inferior. Calcium carbonate has been known as the filler for rubber formulations, but is seldom used for golf balls. Particularly, it has never been realized that calcium carbonate contributes to improvement in durability.

The other filler such as clay, barium sulfate, titanium oxide, etc. may be optionally formulated in an amount of not more than 15 parts by weight based on 100 parts by weight of the base rubber.

Zinc acrylate or zinc methacrylate is used, as a vulcanizing (crosslinking) agent, in an amount of 18 to 35 parts by weight based on 100 parts by weight of the base rubber. When the amount of the vulcanizing agent is less than 18 parts by weight based on 100 parts by weight of the base rubber, the vulcanization is insufficient and, therefore, the hardness of the core is low and long flight distance cannot be attained. To the contrary, when the amount of the vulcanizing agent is more than 35 parts by weight based on 100 parts by weight of the base rubber, the core is too hard and shot feel is drastically reduced. Zinc acrylate and zinc methacrylate can be used alone or in combination thereof. It is particularly preferred to use zinc acrylate because higher rebound characteristics are obtained. In order to adjust the vulcanization, sulfur or a sulfur type vulcanizing agent may be optionally formulated in an amount of 0.1 to 5 parts by weight based on 100 parts by weight of the base rubber.

Peroxides are used as a vulcanization initiator and examples thereof are dicumyl peroxide, t-butylcumyl peroxide, 2,5-dimethyl-2,5-di(t-butylperoxy)hexane, and 1,1-bis(t-butylperoxy)3,3,5-trimethylcyclohexane. Among them, dicumyl peroxide is particularly preferred. The peroxide is used in an amount of 0.5 to 2.5 parts by weight based on 100 parts by weight of the base rubber. When the amount of the peroxide is less than 0.5 parts by weight based on 100 parts by weight of the base rubber, the vulcanization reaction proceeds slowly or the vulcanization is insufficient. Therefore, the hardness of the core is low and flight distance is lowered. On the other hand, when the amount of the peroxide is more than 2.5 parts by weight based on 100 parts by weight of the base rubber, the vulcanization rate is too high or the vulcanization is not stable. As a result, the hardness of the golf ball is too hard or the golf ball is likely to be chemically deteriorated.

A vulcanization auxiliary or vulcanization adjustor, for example, zinc oxide, stearic acid, zinc stearate, etc. may be optionally formulated in an amount of not more than 10 parts by weight based on 100 parts by weight of the base rubber.

The rubber composition for the core is prepared by kneading the above respective components using a Banbury, mixer, kneader, open roll, etc.

The core is produced by vulcanization (crosslinking) molding the above rubber composition for the core in a mold. The vulcanization is generally conducted by heating at 145 to 180° C. under pressure for 10 to 40 minutes.

In the present invention, the cover is made of a resin composition having a stiffness of 1,400 to 3,800 kgf/cm$^2$. When the stiffness of the resin composition for the cover is less than 1,400 kgf/cm$^2$, the flight distance is poor. On the other hand, when the stiffness of the resin composition for the cover is more than 3,800 kgf/cm$^2$, the shot feel and durability are poor. The hardness (Shore D-scale hardness) of the cover is preferably from 60 to 72.

The resin used in the resin composition for the cover generally is an ionomer or that prepared by optionally blending (mixing) the ionomer as a main material with a thermoplastic elastomer (e.g. polyethylene, polyester, polyamide, polyurethane, etc.).

Examples of the above ionomer resins will be shown by their trade name. Examples of those commercially available from Mitsui Du Pont Polychemical Co., Ltd. include ionomer resins such as Hi-milan 1605, (Na), Hi-milan 1707 (Na), Hi-milan AM7318, (Na), Hi-milan 1557 (Zn), Hi-milan 1652 (Zn), Hi-milan 1705 (Zn), Hi-milan 1706 (Zn), AM7315 (Zn), Hi-milan AM7317 (Zn), Hi-milan AM7311 (Mg), Hi-milan MK7320 (K); terpolymer ionomer resins such as Hi-milan 1856 (Na), Hi-milan 1855 (Zn), Hi-milan AM7316 (Zn), etc. Examples of those commercially available from Du Pont U.S.A. Co. include ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li); terpolymer ionomer resins such as Surlyn AD8265 (Na), Surlyn AD8269 (Na), etc. Examples of those commercially available from Exxon chemical Co. include ionomer resins such as lotek 7010 (Zn), lotek 8000 (Na), etc. These are used alone or in combination thereof. Further, Na, Zn, K, Li, Mg, etc., which are described in parentheses at the back of the trade name of the above ionomer resin show neutralization metal ion species, respectively. The particular ionomer is not limited to those described above.

Pigments such as titanium dioxide, barium sulfate, etc. can be optionally contained in the resin composition for the cover. If appropriate, additives such as antioxidants, etc. can also be contained.

The method for applying the covering to the cover on the core is not specifically limited, but may be a conventional method. For example, there can be used a method comprising molding a resin composition for the cover into a semi-spherical half-shell in advance, covering a core with two half-shells and then subjecting it to pressure molding at 130 to 170° C. for 1 to 15 minutes, or a method comprising injection molding the resin composition for the cover directly on the cover the core. The thickness of the cover is generally about 1 to 4 mm. In case of the cover molding, dimples may be formed on the surface of the ball, if necessary. Further, if necessary, a paint or marking may be provided after molding the cover.

In the present invention, it is necessary that the total volume of dimples to be formed on the cover is from 250 to 400 mm$^3$, preferably. from 280 to 350 mm$^3$. When the total volume of dimples is less than 250 mm$^3$, the golf ball is blown by the wind and thus a long flight distance cannot be attained. On the other hand, when the total volume of dimples is more than 400 mm$^3$, the trajectory of the golf ball is low and a long flight distance is not attained.

A typical embodiment of the golf ball of the present invention will be explained with reference to the accompanying drawing.

FIG. 1 is a schematic cross section illustrating one embodiment of the golf ball of the present invention. The golf ball shown in FIG. 1 is a two-piece golf ball comprising a core 1 and a cover 2 for covering the core.

The core 1 is composed of a vulcanized molded article of a rubber composition comprising 100 parts by weight of a base rubber containing not less than 80% by weight of a butadiene rubber having not less than 80 molar % of a cis-1,4 bond, 10 to 30 parts by weight of calcium carbonate, 18 to 35 parts by weight of zinc acrylate or methacrylate and 0.5 to 2.5 parts by weight of a peroxide. The cover 2 is made of a resin composition having a stiffness of 1,400 to 3,800 kgf/cm$^2$.

Dimples 3 are formed on the cover 2 and the total volume of these dimples 3 is from 250 to 400 mm$^3$. The number of these dimples is preferably from 250 to 550 per golf ball.

As described above, according to the present invention, there is provided a golf ball having excellent durability, sufficient for driving range use, while maintaining sufficient flight distance and shot feel.

EXAMPLES

The following Examples and Comparative Examples further illustrate the present invention in detail but are not to be construed to limit the scope thereof.

Examples 1 to 6 and Comparative Examples 1 to 12

The golf balls of Examples 1 to 6 and Comparative Examples 1 to 12 were produced via the following steps (i) to (iii).

(i) Production of Core

A solid core was produced by preparing a rubber composition for core according to the formulations shown in Tables 1 to 5, charging the resulting rubber composition in a mold, followed by vulcanization molding at 160° C. for 25 minutes. An average diameter of the resulting core was 38.2 mm. The formulations of the rubber compositions for core of Examples 1 to 3 are shown in Table 1, those of Examples 4 to 6 are shown in Table 2, those of Comparative Examples 1 to 4 are in Table 3, those of Comparative Examples 5 to 8 in Table 4 and those of Comparative Examples 9 to 12 in Table 5. An amount of each component formulated in the tables is represented by parts by weight, and components whose details are not described in the tables and components represented by their trade names will be described in detail at the back of Table 5.

(ii) Preparation of Resin Composition for Cover

Resin compositions for cover were prepared according to the formulations shown in Tables 1 to 5. The formulations of the resin compositions for cover of Examples 1 to 3 are shown in Table 1, those of Examples 4 to 6 are in Table 2, those of Comparative Examples 1 to 4 are in Table 3, those of Comparative Examples 5 to 8 are in Table 4 and those of Comparative Examples 9 to 12 are in Table 5. Also, the amount of each component formulated in the tables is represented by parts by weight.

TABLE 1

| | Example No. | | |
|---|---|---|---|
| | 1 | 2 | 3 |
| Formulation of rubber composition for core: | | | |
| Butadiene rubber | 100 | 100 | 100 |
| Calcium carbonate *1 | 20 | 23 | 25 |
| Zinc oxide | 3 | 5 | 5 |
| Zinc acrylate | 25 | 25 | 25 |
| Vulcanization adjustor *2 | 0.2 | 0.2 | 0.2 |
| Dicumyl peroxide | 2.3 | 2.0 | 1.8 |
| Formulation of resin composition for cover: | | | |
| Hi-milan 1706 *3 | 30 | 0 | 58 |
| Hi-milan 1557 *4 | 0 | 30 | 0 |
| Hi-milan 1605 *5 | 40 | 30 | 0 |
| Hi-milan 1855 *6 | 0 | 40 | 22 |
| Hi-milan 1707 *7 | 30 | 0 | 0 |
| Hi-milan 1705 *8 | 0 | 0 | 20 |
| Titanium dioxide | 1 | 1 | 1 |
| Barium sulfate | 2 | 2 | 2 |

TABLE 2

| | Example No. | | |
|---|---|---|---|
| | 4 | 5 | 6 |
| Formulation of rubber composition for core: | | | |
| Butadiene rubber | 100 | 100 | 100 |
| Calcium carbonate *1 | 25 | 28 | 15 |
| Zinc oxide | 5 | 5 | 5 |
| Zinc acrylate | 30 | 25 | 30 |
| Vulcanization adjustor *2 | 0.2 | 0.2 | 0.5 |
| Dicumyl peroxide | 1.6 | 1.6 | 0.9 |
| Formulation of resin composition for cover: | | | |
| Hi-milan 1706 *3 | 0 | 58 | 30 |
| Hi-milan 1557 *4 | 0 | 0 | 0 |
| Hi-milan 1605 *5 | 22 | 0 | 40 |
| Hi-milan 1855 *6 | 78 | 22 | 0 |
| Hi-milan 1707 *7 | 0 | 0 | 30 |
| Hi-milan 1705 *8 | 0 | 0 | 0 |
| Titanium dioxide | 1 | 1 | 1 |
| Barium sulfate | 2 | 2 | 2 |

TABLE 3

| | Comparative Example No. | | | |
|---|---|---|---|---|
| | 1 | 2 | 3 | 4 |
| Formulation of rubber composition for core: | | | | |
| Butadiene rubber *1 | 100 | 100 | 100 | 100 |
| Natural rubber | 0 | 0 | 0 | 0 |
| Calcium carbonate | 23 | 23 | 23 | 23 |
| Zinc oxide | 5 | 5 | 5 | 5 |
| Zinc acrylate | 25 | 25 | 25 | 25 |
| Vulcanization adjustor *2 | 0.2 | 0.2 | 0.2 | 0.2 |
| Dicumyl peroxide | 1.8 | 1.8 | 1.8 | 1.8 |
| Formulation of resin composition for cover: | | | | |
| Hi-milan 1706 *3 | 0 | 0 | 58 | 58 |
| Hi-milan 1855 *6 | 0 | 100 | 22 | 22 |
| Hi-milan 1705 *8 | 0 | 0 | 20 | 20 |
| Hi-milan AM7317 *9 | 50 | 0 | 0 | 0 |
| Hi-milan AM7318 *10 | 50 | 0 | 0 | 0 |
| Titanium dioxide | 1 | 1 | 1 | 1 |
| Barium sulfate | 2 | 2 | 2 | 2 |

TABLE 4

| | Comparative Example No. | | | |
|---|---|---|---|---|
| | 5 | 6 | 7 | 8 |
| Formulation of rubber composition for core: | | | | |
| Butadiene rubber *1 | 100 | 100 | 70 | 100 |
| Natural rubber | 0 | 0 | 30 | 0 |
| Calcium carbonate | 8 | 35 | 23 | 35 |
| Zinc oxide | 10 | 5 | 5 | 5 |
| Zinc acrylate | 25 | 25 | 25 | 10 |
| Vulcanization adjustor *2 | 0.2 | 0.2 | 0.2 | 0.2 |
| Dicumyl peroxide | 1.8 | 1.8 | 1.8 | 1.8 |
| Formulation of resin composition for cover: | | | | |
| Hi-milan 1706 *3 | 58 | 58 | 58 | 58 |
| Hi-milan 1855 *6 | 22 | 22 | 22 | 22 |
| Hi-milan 1705 *8 | 20 | 20 | 20 | 20 |
| Titanium dioxide | 1 | 1 | 1 | 1 |
| Barium sulfate | 2 | 2 | 2 | 2 |

TABLE 5

| | Comparative Example No. | | | |
|---|---|---|---|---|
| | 9 | 10 | 11 | 12 |
| Formulation of rubber composition for core: | | | | |
| Butadiene rubber *1 | 100 | 100 | 100 | 100 |
| Natural rubber | 0 | 0 | 30 | 0 |
| Calcium carbonate | 8 | 23 | 23 | 0 |
| Zinc oxide | 5 | 5 | 5 | 23 |
| Zinc acrylate | 40 | 25 | 25 | 30 |
| Vulcanization adjustor *2 | 0.2 | 0.2 | 0.2 | 0.2 |
| Dicumyl peroxide | 1.8 | 0.3 | 3 | 1.2 |
| Formulation of resin composition for cover: | | | | |
| Hi-milan 1706 *3 | 58 | 58 | 58 | 58 |
| Hi-milan 1855 *6 | 22 | 22 | 22 | 22 |
| Hi-milan 1705 *8 | 20 | 20 | 20 | 20 |
| Titanium dioxide | 1 | 1 | 1 | 1 |
| Barium sulfate | 2 | 2 | 2 | 2 |

*1 Butadiene rubber BR-11 (trade name) manufactured by Japan Synthetic Rubber Co., Ltd., content of cis-1,4 bond: 96 molar %
*2 Vulcanization adjustor Noclak NS-6 (trade name) manufactured by Ohuchi Sinko Kagaku Kogyo Co., Ltd.
*3 Hi-milan 1706 (trade name) ethylene-methacrylic acid copolymer ionomer resin obtained by neutralizing with a zinc ion, manufactured by Mitsui Du Pont Polychemical Co., stiffness: 3360 kgf/cm$^2$, Shore D-scale hardness 66
*4 Hi-milan 1557 (trade name) ethylene-methacrylic acid copolymer ionomer resin obtained by neutralizing with a zinc ion, manufactured by Mitsui Du Pont Polychemical Co., stiffness: 2550 kgf/cm$^2$, Shore D-scale hardness: 63
*5 Hi-milan 1605 (trade name) ethylene-methacrylic acid copolymer ionomer resin obtained by neutralizing with a sodium ion, manufactured by Mitsui Du Pont Polychemical Co., stiffness: stiffness: 3770 kgf/cm$^2$, Shore D-scale hardness: 67
*6 Hi-milan 1855 (trade name) ethylene methacrylic acid-acrylate three-dimensional polymer ionomer resin obtained by neutralizing with a zinc ion, manufactured by Mitsui Du Pont Polychemical Co., stiffness: 917 kgf/cm$^2$, Shore D-scale hardness: 56
*7 Hi-milan 1707 (trade name) ethylene-methacrylic acid copolymer ionomer resin obtained by neutralizing with a sodium ion, manufactured by Mitsui Du Pont Polychemical Co., stiffness: 3870 kgf/cm$^2$, Shore D-scale hardness: 68
*8 Hi-milan 1705 (trade name) ethylene-methacrylic acid copolymer ionomer resin obtained by neutralizing with a zinc ion, manufactured by Mitsui Du Pont Polychemical Co., stiffness: 2350 kgf/cm$^2$, Shore D-scale hardness: 62
*9 Hi-milan AM7317 (trade name) ethylene-methacrylic acid copolymer ionomer resin obtained by neutralizing with a zinc ion, manufactured by Mitsui Du Pont Polychemical Co., stiffness: about 2755 kgf/cm$^2$, Shore D-scale hardness: 62
*10 Hi-milan AM7318 (trade name) ethylene-methacrylic acid copolymer ionomer resin obtained by neutralizing with a sodium ion, manufactured by Mitsui Du Pont Polychemical Co., stiffness: about 3469 kgf/cm$^2$, Shore D-scale hardness: 65

(iii) Production of Golf Ball

The resin composition for the cover of the above item (ii) was injection molded directly onto core of the above item (i) to cover the core with a cover containing dimples, and then the resulting golf ball was painted to produce a golf ball having an outer diameter of 42.7 mm.

The ball compression, flight distance (carry), durability and shot feel of the resulting golf ball were measured. The flexural modulus Shore D-scale hardness of the resin composition for the cover and total volume of the resulting golf ball were examined. The results are shown in Tables 6 to 10.

The flexural modulus of the resin compositions of Examples 1 to 3, Shore D-scale hardness, total volume of dimples, ball compression, flight distance, durability and shot feel are shown in Table 6. Those of Examples 4 to 6 are shown in Table 7, those of Comparative Examples 1 to 4 are in Table 8, those of Comparative Examples 5 to 8 are in Table 9 and those of Comparative Examples 9 to 12 are shown in Table 10. The measuring or evaluating method of the flexural modulus, Shore D-scale hardness, total volume of dimples, ball compression, flight distance, durability and shot feel are as follows.

Flexural Modulus

The flexural modulus is measured according to ASTM D-747 after storing a hot press molded sheet having a thickness of about 2 mm at 23° C. for 2 weeks.

Shore D-scale Hardness

The Shore D-scale hardness is measured by pressing a hardness tester to a golf ball after storing the golf ball at 23° C. for 24 hours.

Total Volume of Dimples

Figure 2:
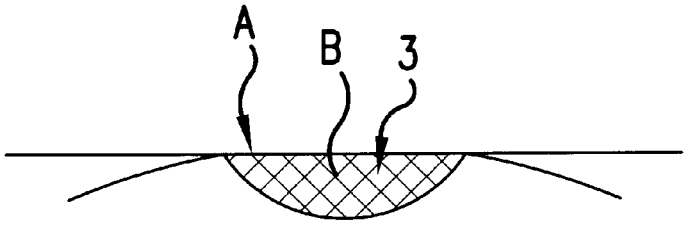
FIG. 2 is a schematic cross section illustrating the dimple and the peripheral part thereof, where a tangent line is provided at the open face of the dimple for facilitating an understanding of how the volume of the dimple is measured.

A process for determining the total volume of dimples will be explained with reference to a schematic cross section of dimples shown in FIG. 2. That is, the area B (area provided with a checkered pattern) bounded by the bottom part of the dimple 3 and line A is determined as a volume of the dimple, and then the total volume of dimples is determined from the volume of dimples and total number of dimples provided on the surface of the golf ball.

Ball Compression

It is measured according to a PGA system.

Flight Distance

A No. 1 wood club was mounted to a swing robot manufactured by True Temper Co. and a golf ball was hit with the club at a head speed of 45 m/second. Then, a distance to the dropping point to the ground was measured.

Durability

A No. 1 wood club was mounted to a swing robot manufactured by True Temper Co. and a golf ball was hit with the club at a head speed of 45 m/second. Then, the number of times until breakage arose was measured. The resulting value was indicated as a durability index in case of the impact resistance number (number of times until breakage arose) of the golf ball of Comparative Example 6 being 100.

Shot Feel

The shot feel of the golf ball is evaluated by 3 professional golfers and 27 amateur golfers having a handicap within the range from 1 to 10 (total: 30 golfers) according to a practical hitting test using a No. 1 wood club. The evaluation criteria are as follows. The results shown in the Tables below are based on the fact that not less than 23 out of 30 golfers evaluated with the same criterion about each test item.

Evaluation Criteria

◎: Very good
○: Good
Δ: Ordinary
×: Inferior

TABLE 6

| | Example No. | | |
|---|---|---|---|
| | 1 | 2 | 3 |
| Flexural modulus (kgf/cm$^2$) | 3500 | 2000 | 2500 |
| Shore D-scale hardness | 69 | 62 | 64 |
| Total volume of dimples (mm$^3$) | 330 | 350 | 280 |
| Ball compression | 97 | 94 | 95 |
| Flight distance (yard) | 224 | 225 | 225 |
| Durability (index) | 104 | 109 | 109 |
| Shot feel | ◎ | ◎ | ◎ |

TABLE 7

| | Example No. | | |
|---|---|---|---|
| | 4 | 5 | 6 |
| Flexural modulus (kgf/cm$^2$) | 1400 | 3100 | 3600 |
| Shore D-scale hardness | 60 | 67 | 70 |
| Total volume of dimples (mm$^3$) | 330 | 330 | 330 |
| Ball compression | 90 | 98 | 100 |
| Flight distance (yard) | 224 | 226 | 229 |
| Durability (index) | 103 | 115 | 120 |
| Shot feel | ◎ | ◎ | ◎ |

TABLE 8

| | Comparative Example No. | | | |
|---|---|---|---|---|
| | 1 | 2 | 3 | 4 |
| Flexural modulus (kgf/cm$^2$) | 4000 | 900 | 2500 | 2500 |
| Shore D-scale hardness | 74 | 56 | 64 | 64 |
| Total volume of dimples (mm$^3$) | 330 | 330 | 200 | 410 |
| Ball compression | 142 | 73 | 95 | 95 |
| Flight distance (yard) | 228 | 184 | 214 | 218 |
| Durability (index) | 109 | 146 | 109 | 109 |
| Shot feel | x | ○ | ◎ | ◎ |

TABLE 9

| | Comparative Example No. | | | |
|---|---|---|---|---|
| | 5 | 6 | 7 | 8 |
| Flexural modulus (kgf/cm$^2$) | 2500 | 2500 | 2500 | 2500 |
| Shore D scale hardness | 64 | 64 | 64 | 64 |
| Total volume of dimples (mm$^3$) | 330 | 330 | 330 | 330 |
| Ball compression | 97 | 99 | 62 | 41 |
| Flight distance (yard) | 219 | 219 | 184 | 220 |
| Durability (index) | 95 | 100 | 112 | 78 |
| Shot feel | Δ | Δ | Δ | x |

TABLE 10

| | Comparative Example No. | | | |
|---|---|---|---|---|
| | 9 | 10 | 11 | 12 |
| Flexural modulus (kgf/cm$^2$) | 2500 | 2500 | 2500 | 2500 |
| Shore D-scale hardness | 64 | 64 | 64 | 64 |
| Total volume of dimples (mm$^3$) | 330 | 330 | 330 | 330 |
| Ball compression | 136 | 65 | 133 | 110 |
| Flight distance (yard) | 200 | 191 | 224 | 220 |
| Durability (index) | 125 | 73 | 120 | 87 |
| Shot feel | x | Δ | x | x |

As is apparent from a comparison between the characteristics of the golf balls of Examples 1 to 6 shown in Tables 6 and 7 and those of the golf balls of Comparative Examples 1 to 12 shown in Tables 8 to 10, all golf balls of Examples 1 to 6 attained a long flight distance and had good shot feel and excellent durability.

That is, the golf balls wherein the core is composed of a vulcanized molded article of a rubber composition comprising 100 parts by weight of a butadiene rubber having not less than 80 molar % of a cis-1,4 bond, 10 to 30 parts by weight of calcium carbonate, 18 to 35 parts by weight of zinc acrylate or methacrylate and 0.5 to 2.5 parts by weight of a peroxide, and wherein the cover is made of a resin composition having a flexural modulus of 1,400 to 3,800 kgf/cm$^2$ and the total volume of dimples of the cover is from 250 to 400 mm$^3$ of Examples 1 to 6 of the present invention attained a long flight distance such as 224 to 229 yards and had good shot feel and durability which is better than that of the golf balls of Comparative Example 6 for a criterion of comparison with respect to durability. The golf ball of Comparative Example 6 is a golf ball having a durability enough to be used as a golf ball for driving ranges.

To the contrary, as shown in Table 8, the golf ball of Comparative Example 1 was inferior in shot feel because the flexural modulus of the resin composition for the cover is large such as 4000 kgf/cm$^2$. The golf ball of Comparative Example 2 did not attain a large flight distance because the flexural modulus of the resin composition for the cover is small such as 900 kgf/cm$^2$. The golf ball of Comparative Example 3 did not attain a large flight distance because the total volume of dimples is small, such as 200 mm$^3$. The golf ball of Comparative Example 4 did not attain sufficiently large flight distance because the total volume of dimples is large such as 410 mm$^3$.

As is shown in Tables 4 and 9, the golf ball of Comparative Example 5 attained a small flight distance and had inferior durability and insufficient shot feel because the amount of calcium carbonate formulated was small. The golf ball of Comparative Example 6 attained a small flight distance and had insufficient shot feel because the amount of calcium carbonate formulated was too large. The golf ball of Comparative Example 7 did not attain a large flight distance because the base rubber contained a natural rubber as much as 30% by weight. Regarding the golf ball of Comparative Example 8, the vulcanization did not proceed sufficiently because the amount of zinc acrylate formulated was too small. Therefore, the durability was inferior and the shot feel was inferior because the core was too soft.

As is shown in Tables 5 and 10, the golf ball of Comparative Example 9 had an inferior shot feel and attained a short flight distance because the amount of calcium carbonate formulated was small and that of zinc acrylate was too large. Regarding the golf ball of Comparative Example 10, the core was to soft due to the lack of vulcanization degree because the amount of dicumyl peroxide formulated was too small. Therefore, durability was inferior and flight distance was small. Regarding the golf ball of Comparative Example 11, the core was hard and shot feel was inferior because the amount of dicumyl peroxide formulated was too high. The golf ball of Comparative Example 12 had inferior durability because no calcium carbonate was formulated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball comprising a core and a cover covering the core, wherein the core consists essentially of a vulcanized molded article of a rubber composition consisting of 100 parts by weight of a base rubber containing not less than 80% by weight of a butadiene rubber having not less than 80 molar % of cis-1,4 bond, 10 to 30 parts by weight of calcium carbonate, 18 to 35 parts by weight of zinc acrylate or methacrylate and 0.5 to 2.5 parts by weight of a peroxide, and the cover is made form a resin composition having a flexural modulus of 1,400 to 3,800 kgf/cm$^2$, wherein the total volume of dimples of the cover is from 250 to 400 mm$^3$.

2. The golf ball according to claim 1 wherein said cover is formed from an ionomer resin.

3. The golf ball according to claim 1 wherein the number of dimples is 250 to 550 in one golf ball.

4. The golf ball according to claim 1 wherein the Shore D-scale hardness of the cover is 60 to 72.

5. The golf ball according to claim 1 wherein the peroxide is selected from the group consisting of dicumyl peroxide, t-butylcumyl peroxide, 2,5-dimethyl-2,5-di(t-butylperoxy) hexane, and 1,1-bis(t-butylperoxy)3,3,5-trimethylcyclohexane.

6. A method of making a two-piece solid golf ball having a core and a cover covering the core, wherein said method comprises forming (1) a core which consists of a vulcanized molded rubber composition of (i) 100 parts by weight of a base rubber containing not less than 80% by weight of a butadiene rubber having not less than 80 molar % of cis-1,4 bone, (ii) 10 to 30 parts by weight of calcium carbonate, (iii) 18 to 35 parts by weight of zinc acrylate or methacrylate, and (iv) 0.5 to 2.5 parts by weight of a peroxide, and (2) a cover made from a resin composition having a flexural modulus of 1,400 to 3,800 kgf/cm$^2$, wherein the cover contains a total volume of dimples from 250 to 400 mm$^3$.

7. The method according to claim 6, wherein said cover is made from an ionomer resin.

8. The method according to claim 6, wherein the number of dimples is 250 to 550 in one golf ball.

9. The method according to claim 6, wherein the Shore D-scale hardness of the cover is 60 to 72.

10. The method according to claim 6, wherein the peroxide is selected from the group consisting of dicumyl peroxide, t-butylcumyl peroxide, 2,5-dimethyl-2,5-di(t-butylperoxy)hexane, and 1,1-bis(t-butylperoxy)3,3,5-trimethylcyclohexane.

* * * * *